US006770215B2

(12) United States Patent
Giusti

(10) Patent No.: US 6,770,215 B2
(45) Date of Patent: Aug. 3, 2004

(54) LOW LEAD RELEASE PLUMBING COMPONENTS MADE OF COPPER BASED ALLOYS CONTAINING LEAD, AND A METHOD FOR OBTAINING THE SAME

(75) Inventor: Aldo Giusti, Fornaci di Barga (IT)

(73) Assignee: Europa Metalli S.p.A., Florence (IT)

( * ) Notice: Subject to any disclaimer, the term of this patent is extended or adjusted under 35 U.S.C. 154(b) by 189 days.

(21) Appl. No.: 10/195,992

(22) Filed: Jul. 16, 2002

(65) Prior Publication Data

US 2002/0189721 A1 Dec. 19, 2002

Related U.S. Application Data

(62) Division of application No. 09/845,439, filed on Apr. 30, 2001, now Pat. No. 6,461,534, which is a division of application No. 08/875,881, filed as application No. PCT/IT95/00136 on Aug. 3, 1995, now Pat. No. 6,270,590.

(51) Int. Cl.[7] ..... B44C 1/22
(52) U.S. Cl. ..... 216/105
(58) Field of Search ..... 148/282, 901; 134/3; 216/105, 106, 107

(56) References Cited

U.S. PATENT DOCUMENTS

| | | | | |
|---|---|---|---|---|
| 3,556,883 | A | 1/1971 | Naito et al. | 156/20 |
| 3,888,778 | A | 6/1975 | Beckwtith et al. | 252/79.1 |
| 4,097,394 | A | 6/1978 | Gerlach et al. | 252/79.5 |

(List continued on next page.)

FOREIGN PATENT DOCUMENTS

| | | |
|---|---|---|
| DE | 802974 | 1/1951 |
| DE | 2849894 | 5/1980 |
| DE | 3501422 | 8/1985 |
| DE | 3422327 | 12/1985 |
| DE | 3619881 | 12/1987 |
| DE | 4313439 | 10/1994 |
| EP | 0179364 | 4/1986 |
| EP | 06863245 | 11/1995 |
| GB | 1320589 | 6/1973 |
| GB | 1503376 | 3/1978 |
| WO | 9424379 | 10/1994 |

OTHER PUBLICATIONS

Materials Performance, vol. 29, No. 8, Aug. 1, 1990, pp. 45–49, XP 000175798, Boffardi B P "Minimization of Lead Corrosion in Drinking Water".

Derwent's English Abstract of DE 3501422 Dated Aug. 22, 1985.

Derwent's English Abstract of EP 0179364 Dated Apr. 30, 1986 and English Translation of Claims 1 Through 9.

Derwent Abstract: DE2849894 dated May 29, 1980.

*Primary Examiner*—Sikyin Ip
(74) *Attorney, Agent, or Firm*—Ladas & Parry

(57) ABSTRACT

Lead brass components for potable water distribution circuits (e.g., plumbing components made of CuZn39Pb3, containing 3% Pb), also chronium plated ones, are subjected to a lead-selective surface etching to reduce, in operation, the release of Pb caused by Pb surface "smearing", resulting either from machining or molding; said elements are firstly contacted by an aqueous solution of an acid capable of forming soluble Pb salts, preferably a non-oxidizing solution, by simply dipping the components in the solution, e.g., a solution of 0.1 M sulfamic acid, at 20°–50° C. for 10 to 50 minutes, and, subsequently, the elements are passivated by immersion into a strong base aqueous solution, e.g., a solution of 0.1 M NaOH at 20°–25° C., for approximately 10 minutes; in this manner, plumbing components made of a copper based alloy containing Pb are obtained, which components, after 15 days of test according to US NSF STD61 procedure, release Pb in an amount less than 0.025 μg for each ml of the internal volume of the component delimited by metallic walls remained in contact with water during the testing period.

1 Claim, 7 Drawing Sheets

U.S. PATENT DOCUMENTS

| | | | | |
|---|---|---|---|---|
| 4,687,545 | A | | 8/1987 | Williams et al. ..... 156/651 |
| 4,716,955 | A | | 1/1988 | Fastert ..... 164/475 |
| 4,774,995 | A | | 10/1988 | Fastert ..... 164/418 |
| 4,964,920 | A | | 10/1990 | Jackson et al. ..... 134/3 |
| 5,035,749 | A | | 7/1991 | Haruta et al. ..... 134/2 |
| 5,137,657 | A | | 8/1992 | Boffardi ..... 252/387 |
| 5,409,053 | A | | 4/1995 | Kawa et al. ..... 164/418 |
| 5,411,595 | A | | 5/1995 | Bokisa, Sr. et al. ..... 134/2 |
| 5,469,910 | A | | 11/1995 | Kawa et al. ..... 164/459 |
| 5,470,636 | A | * | 11/1995 | Wakui et al. ..... 428/141 |
| 5,601,658 | A | | 2/1997 | Marinas et al. ..... 134/3 |
| 5,612,224 | A | | 3/1997 | O'Brien ..... 436/73 |
| 5,958,257 | A | | 9/1999 | Regelbrugge et al. ..... 148/525 |
| 6,270,590 | B1 | | 8/2001 | Giusti ..... 148/282 |

* cited by examiner

FIG. 9A
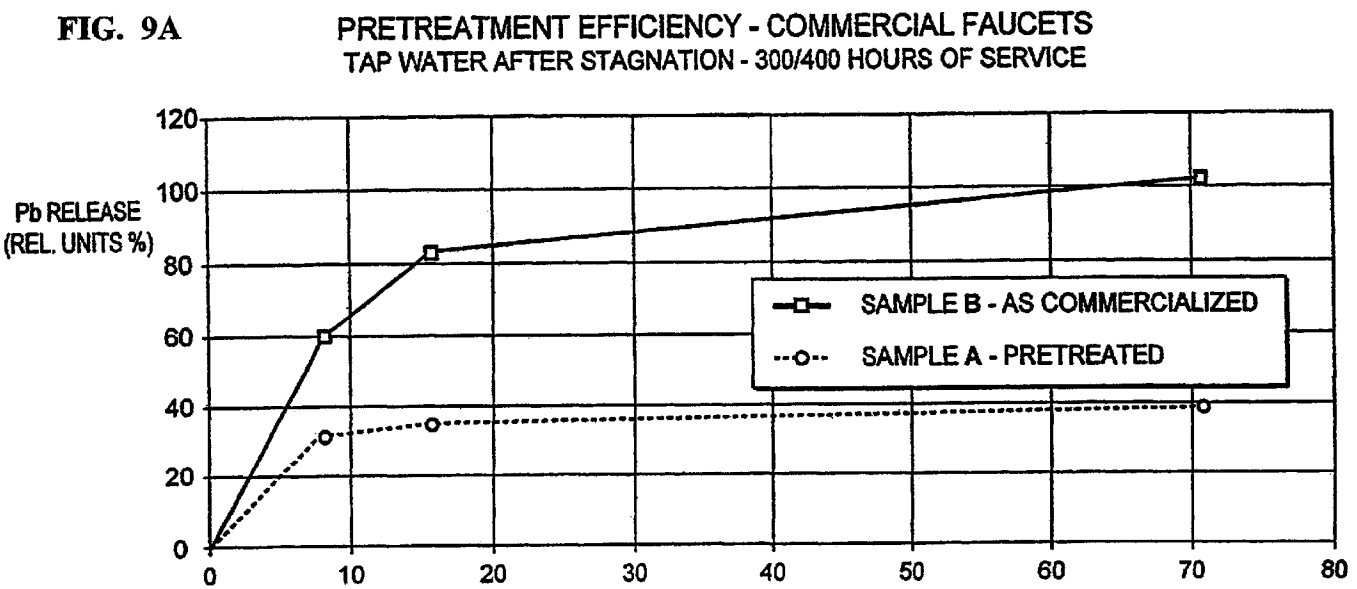
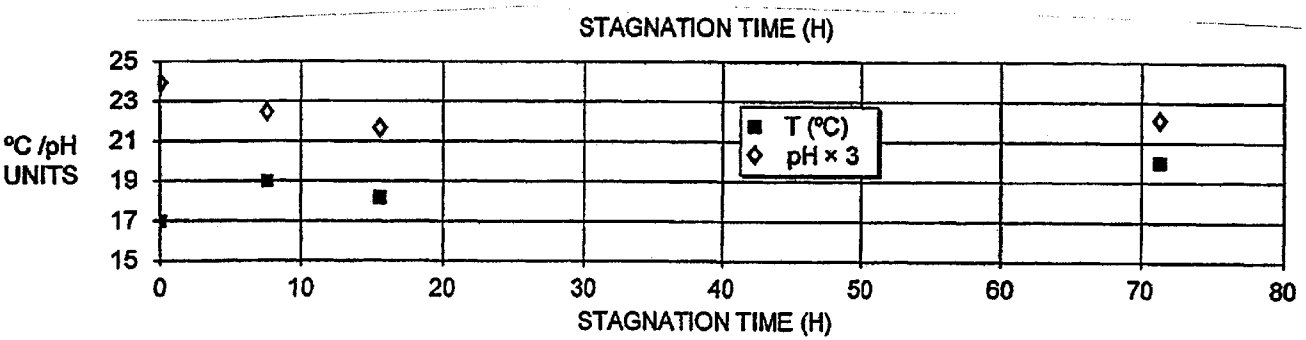
FIG. 9B

LOW LEAD RELEASE PLUMBING COMPONENTS MADE OF COPPER BASED ALLOYS CONTAINING LEAD, AND A METHOD FOR OBTAINING THE SAME

This application is a divisional of U.S. application Ser. No. 09/845,439 filed on Apr. 30, 2001, now U.S. Pat. No. 6,461,534, issued on Oct. 8, 2002, which is a divisional of U.S. application Ser. No. 08/875,881 filed Nov. 19, 1997, now U.S. Pat. No. 6,270,590, issued on Aug. 7, 2001, which is a 371 of International Application PCT/IT95/00136 filed on Aug. 3, 1995, which is designated the U.S., claims the benefit thereof and incorporates the same by reference.

TECHNICAL FIELD

The present invention relates to low lead release plumbing components made of copper-based alloys containing lead, e.g lead brass components for potable water distribution circuits. The invention further relates to a method for obtaining the same by a selective surface etching thereof in order to either reduce or completely eliminate the labile surface Pb layer (almost exclusively consisting of Pb and/or Pb salts) responsible for the Pb release and representing the so-called Pb surface "smearing".

BACKGROUND ART

Well known is the phenomenon leading to the creation of surface layers of metallic Pb (or of its salts), by segregation of Pb from the base alloy as a consequence of the thermal-mechanical stresses caused by machining and or molding of brass alloy elements containing lead. Such a phenomenon is a particularly undesirable one, in that the creation of the said lead surface layer may easily cause, at work, the release into the environment of Pb ions, a heavy metal known to be highly polluting and toxic to human health.

On the other hand, plumbing components such as mechanic parts for cocks and valves designed to operate in potable water distribution circuits and systems, cannot but undergo, during the manufacturing process, a number of machine work operations (lathing, drilling, threading, etc.). Moreover, a Cu—Zn base alloy containing also limited amounts of Pb (generally up to 3–5% by weight) facilitates machine working and leads to more effective and accurate surface finish. Furthermore, besides facilitating machine working (it furthers chip-breaking), the presence of Pb is also instrumental to the elements forming process, whether the latter is carried out directly by smelting or by molding/die-casting. Document DE-A4313439 solves the problem by isolating the inner surfaces of the component with a material free of Pb, which is difficult to apply.

The mechanism of Pb release has long been investigated and is based on the creation, on a zinc oxide surface layer, segregated from the base alloy, of Pb salts (hydroxycarbonates), due to surface stresses of the alloy as a consequence of both machining and shear stress during the molding process, and due further to Pb reactivity with water vapor and atmosphere carbon dioxide. It is however only very recently (March 1995) that a Certified testing procedure for evaluating the Pb release of plumbing components designed to potable water distribution has been approved and issued in print by the major United States Normalization Agency, i.e. N.S.F. The test procedure is known as U.S. NSF STD61. It has been shown that the phenomenon of Pb release is largely present in the commercial components for potable water distribution of any type, even in those components wherein surface coating, for example chromium or nickel plating, is extensively carried out, for haestetical reasons, on all the surfaces in view: in fact, the phenomenon depends on those limited surfaces designed to remain in contact with water when the taps, cocks ect. are closed, which are internal surfaces not in view and, therefore, normally not coated and, anyway, very difficult to be coated properly.

DISCLOSURE OF THE INVENTION

The aim of the present invention is therefore to furnish low lead release components made of copper-based alloys, in particular brass plumbing components for potable water distribution circuits, which, at the same time, can be subjected to usual working operations, by machining and/or molding, without any drawback with respect to the known alloys containing lead.

The present invention accordingly relates to mechanical components made of a copper-based alloy and and designed to be subjected, during their production stage, to working operations carried out either by machining, molding or die-casting, in particular plumbing components made of brass alloys and designed for potable water distribution systems, said components having respective surfaces defined by said alloy designed to be exposed, in use, to a fluid which is released in the environment, characterized in that said copper-based alloy contains a predetermined amount of lead as an alloying element; and in that, in combination, said surfaces of the components designed to be exposed to said fluid and defined by said alloy are free from surface enrichment of lead and lead salts.

In particular, said components are designed to collect potable water therein and are able to release in synthetic drinking water, after 15 days of test according to U.S. NSF STD61, an amount of Pb of no more than $2.5\times10^{-8}$ kg (0.025 $\mu$g) for each liter (ml) of the internal volume of the components delimited by metallic surfaces exposed to contact with potable water during testing.

It is also included in the invention, according to a further aspect thereof, a mechanical component made of a copper-based alloy containing lead, and subjected, during its production stage, to working operations carried out either by machining, molding or die-casting, in particular a plumbing component made of brass and designed for potable water distribution systems, characterized in that respective surfaces of said component, which surfaces are designed to be contacted in use by potable water, present, under XPS surface analysis, an atomic surface composition such that the surface content in Pb is lower than or equal to the content in Pb according to the nominal composition of the alloy.

The invention further relates to a method for obtaining low Pb-release metal components made of copper-based alloys containing lead and designed to be employed in water distribution systems, in particular lead brass plumbing components for potable water circuits, said method comprising the following steps:

- a selective etching of surfaces of said components designed to be exposed, at work, to the water, for removing almost entirely the Pb and Pb salts present thereon as a consequence of a mechanical working and/or of molding/die casting operations carried out onto said components; and
- a passivation of said surfaces.

In particular, the selective etching step is carried out by exposing said surfaces to the action of a non-oxidizing acidic aqueous solution, of an acid capable of forming soluble Pb salts.

In particular, said acid is selected from the group consisting in: sulfamic acid, fluoboric acid, methanesulfonic acid, fluosilicic acid, acetic acid and mixtures thereof.

According to another embodiment of the invention, the selective etching step is carried out by exposing said surfaces to the action of an oxidizing acidic aqueous solution of an organic acid mixed with a peroxide. Preferably, the organic acid employed is citric acid and the peroxide is hydrogen peroxide.

Said passivation step follows said selective etching step and is carried out by exposure of said surfaces to the action of a basic aqueous solution, preferably a strong base aqueous solution.

Between said two steps, there is also provided for an intermediate rinsing stage.

Preferably, the basic aqueous solution contains a strong base selected from the group consisting in: NaOH, sodium silicate, and mixtures thereof and the passivation step is carried out keeping the solution to a pH comprised between 10 and 13.

Said exposure operations are carried out, according to the invention, by simply dipping said components into said treating solutions; while said rinsing operations are carried out by immersion in tap water at ambient temperature. Moreover, during said exposure to the action of said solutions, said solutions are subjected to ultrasonic agitation, in order to hit said surfaces of the components with ultrasonic waves.

In so doing, the ensuing selective etching of the surface lead, segregated from the alloy, affects, however, neither alloy composition nor surface finish resulting from machining (or from any other kind of working) to which said components have been subjected. Said etching operation, therefore, causes the surface lead, segregated from the alloy, to be removed so that lead is no longer released, during operation, by the elements so treated. Moreover, the removed lead can be easily recovered from the etchant, for example, by electrolysis, particularly in the presence of acid aqueous solutions. The afore process, therefore, guarantees high environmental safety.

The following passivating step, moreover, contributes to create on the exposed surfaces of said components an insoluble layer of corrosion chemicals which prevents both any possible corrosion process to be started in operation on the treated components, even in presence of aggressive fluids such as "soft waters" (potable waters having low contents of dissolved salts, especially of calcium), and the possible dissolution of the Pb not eliminated by the selective etching step (normally left inside open pores of the metallic matrix, which are deemed to be closed by the insoluble layers created by the passivation step.

Molarity range of the non-oxidizing acid, capable of forming soluble Pb salts, in the aqueous solution according to the invention, is 0.01–5 M and, in any case, its values are within the limits of the solubility scale of the chosen acid, while said solution has pH range 1–3. During immersion, according to the invention, the non-oxidizing acid etching solution is kept at a temperature ranging between 20° C. and 50° C. and immersion is carried out for 5 to 50 minutes.

According to the preferred embodiment, the machined elements, to be treated according to the invention, are degreased, rinsed, then dipped, for a period of time not exceeding 25 minutes, into a first aqueous solution of 0.1 M sulfamic acid, at 35° C.–45° C., then subjected to further rinsing, dipped into a second aqueous solution of 0.1 M sodium hydroxide, at 20° C.–25° C. and for a period of time not exceeding 15 min., and, finally, rinsed a third time and dried.

Rinsing is carried out in common tap water, at ambient temperature (13° C.–20° C.).

Finally, the preferred composition of the acidic aqueous solution is a mixture of 0.1 M sulfamic acid and 0.1 M fluoboric acid, in a 1:1 ratio, preferably added with a corrosion inhibitor.

According to a last aspect of the invention, therefore, it is provided an aqueous solution for performing a selective Pb etching mechanical components made of copper-based metal alloys containing Pb, the selective etching being directed against a surface enrichment in Pb and Pb salts of respective surfaces of said components which have been subjected to working operations carried out either by machining, molding or die-casting, said treating solution being characterized in having the following composition:

0.1 M sulfamic acid;

0.1 M fluoboric acid;

from 0.1 to 5% by weight of 1H-benzotriazole.

It is also included in the invention, a treating aqueous solution for performing the passivation of surfaces of mechanical components made of copper-based metal alloys containing Pb, said solution being characterized in containing, in combination: 0.1 M NaOH and from 1 to 5% by weight of sodium metaphosphite. The solution also includes sodium metasilicate, and/or a surface wetting agent, e.g. polyetoxyalchool.

BRIEF DESCRIPTION OF DRAWINGS

The present invention will be further described hereinafter with reference to the following examples and the attached figures, wherein:

FIGS. 9A and 9B are graphs showing the lead release values and temperature/pH respectfully of faucets prepared according to Example 5, infra;

EXAMPLE 1 (COPPER ALLOYS)

Five not etched samples identified as A, B, C, D, and E, are obtained from $5.15\times10^{-3}$ m (5,15 mm) diameter drawn annealed wire in CuZn37Pb3 (according to CEN denomination).

Figure 1:
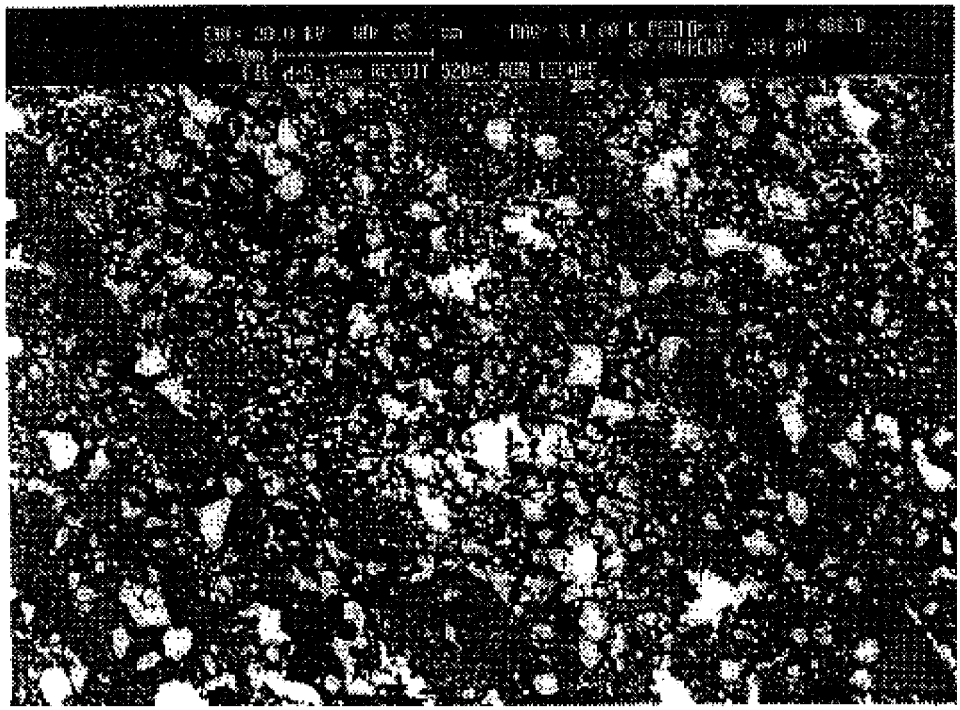
FIG. 1 is a first microphotograph showing the superficial aspect of a drawing wire in CuZn37Pb3 (according to CEN codification) of $5.15\times10^{-3}$ m (5.15 mm) diameter, annealed and not pickled, the white spots being the segregations of Pb and Pb salts due to the stresses caused by working the wires.
Figure 2:
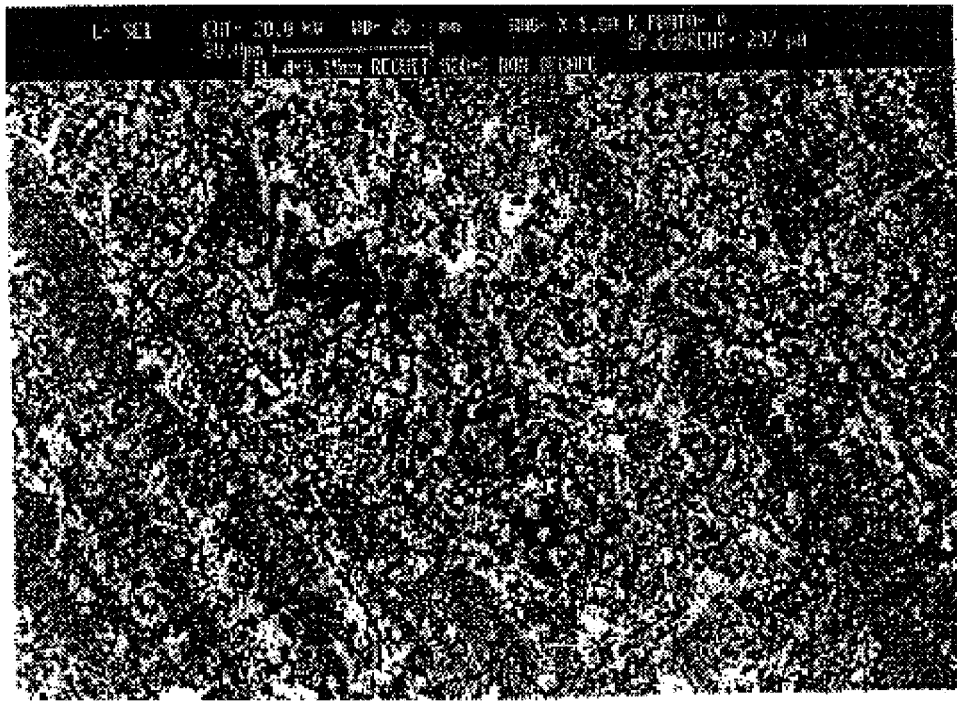
FIG. 2 is a second microphotograph showing the superficial aspect of a drawing wire in CuZn37Pb3 (according to CEN codification) of $5.15\times10^{-3}$ m (5.15 mm) diameter, annealed and not pickled, the white spots being the segregations of Pb and Pb salts due to the stresses caused by the working the wires.
Figure 3:
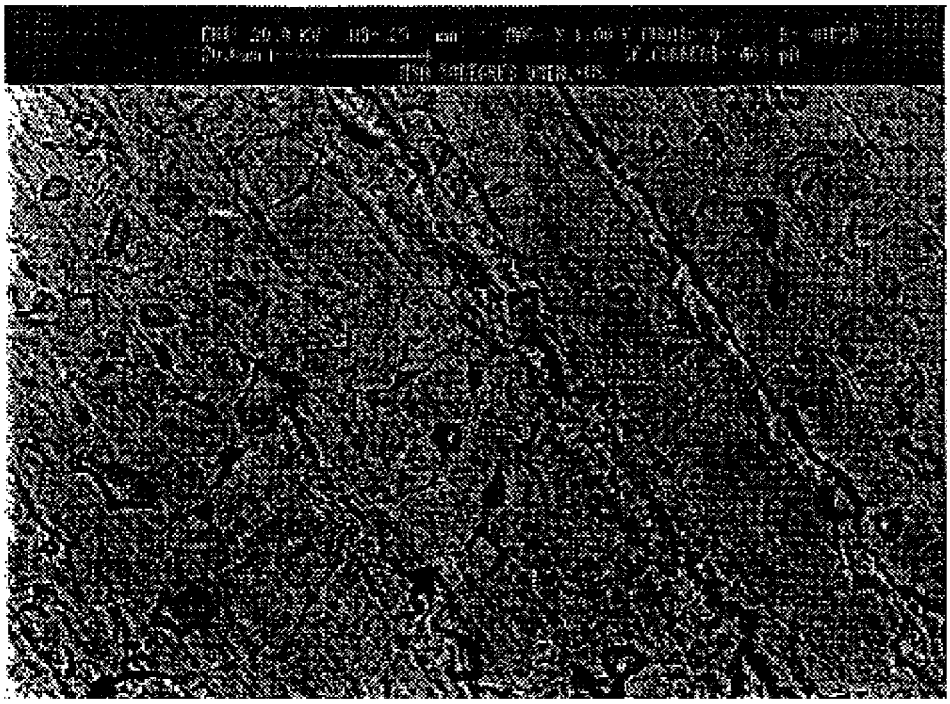
FIG. 3 is a microphotograph showing the superficial aspect of the wire depicted in FIGS. 1 and 2 after it was treated with the non-oxidizing acidic solution of Sample B in Table 1, infra.
Figure 6:
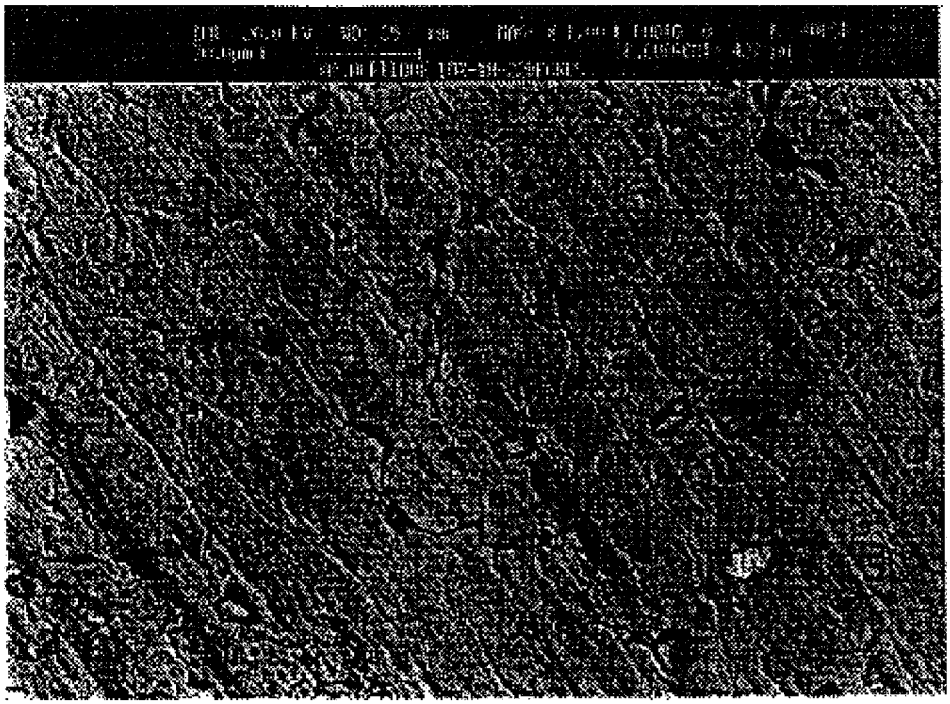
FIG. 6 is a microphotograph showing the superficial aspect of the wire depicted in FIGS. 1 and 2 after it was treated with the acetic acid solution of Sample E in Table 1, infra.
Figure 4:
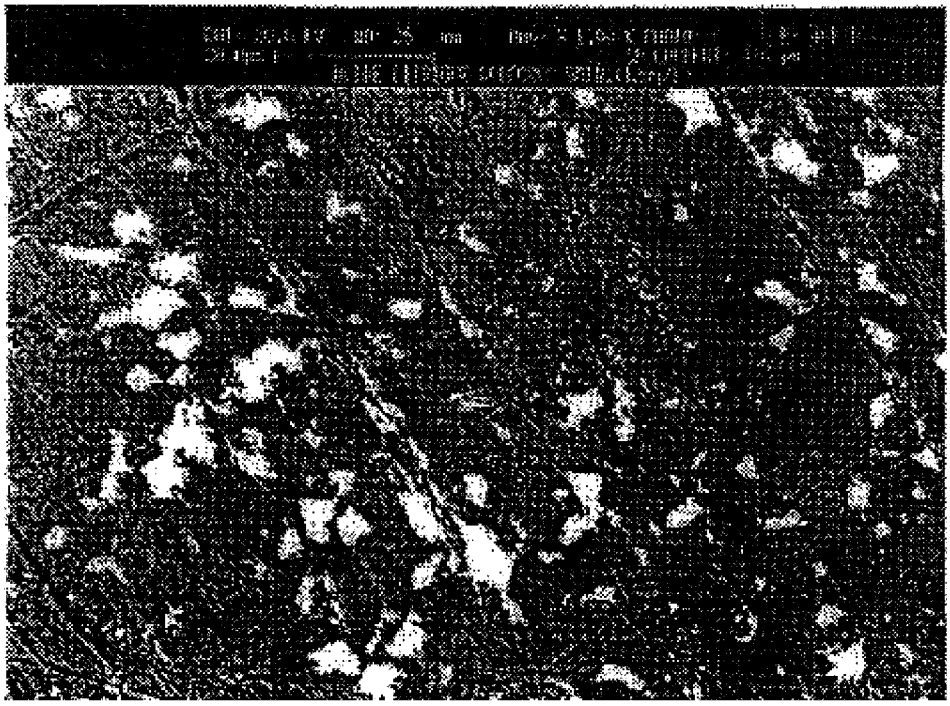
FIG. 4 is a microphotograph showing the superficial aspect of the wire depicted in FIGS. 1 and 2 after it was treated with the acid solution of Sample C in Table 1, infra.
Figure 5:
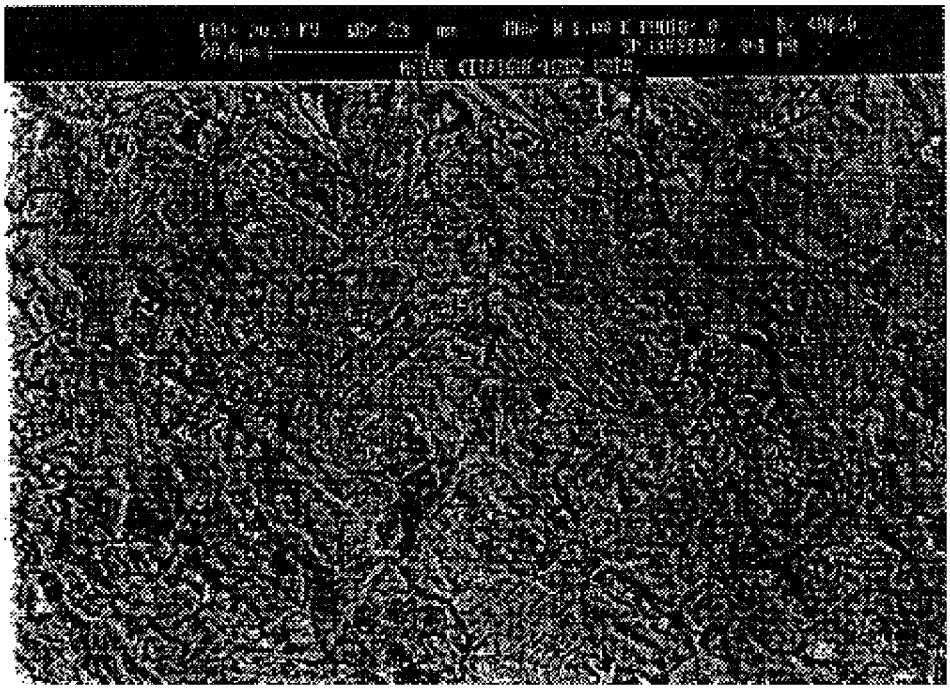
FIG. 5 is a microphotograph showing the superficial aspect of the wire depicted in FIGS. 1 and 2 after it was treated with the acetic acid and $H_2O_2$ solution of Sample D in Table 1, infra.

Sample A, examined by a scanning electron microscope (SEM) gave the results shown in FIGS. 1 and 2. Thereafter, samples B, C, D and E were treated following the procedures collected in Table 1.

TABLE 1

| Sample | Solution | T [° C.] | time [minutes] |
|---|---|---|---|
| B | 35% Methane sulfonic acid + ultrasonic agitation | 50 | 10 |
| C | 12% citric acid | 50 | 10 |
| D | 12% citric acid + 1% $H_2O_2$ | 22 | 10 |
| E | 10% acetic acid | 22 | 50 |

After treatment, rinsing in water and drying with hot air, samples B, C, D and E were examined by SEM technique giving the results reported in FIGS. 3 to 6, respectively. From these micrographies, it appears that methanesulfonic acid and acetic acid are effective in selectively dissolving the surface smeared lead, while citric acid is effective if used in conjunction with an oxidizing agent, as e.g. hydrogen peroxide.

EXAMPLE 2 (COPPER ALLOYS)

Three samples, identified as A, B and C, were taken from the same tar in CuZn39Pb3, extruded and drawn to 0.05 m (50 mm) diameter, normally available in commerce. All samples were drilled and machined with lathe turning operation, under the same working conditions, in order to obtain 0.1 m (100 mm) high cylinders with internal diameter of 0.036 m (36 mm) and external diameter of 0.05 m (50 mm). All samples were degreased and washed with tap water, Sample C was subjected to lead selective dissolution by:

1-immersion in solution "a": 0.1 M sulfamic acid (pH 1.25), at 40° C. for twenty minutes;

2-washing with water;

3-immersion in solution "b": 0.1 M NaOH (pH 12.7) at 40° C. for ten minutes;

4-washing with water and hot air-drying.

The overall amount of lead and copper recovered from solutions "a" and "b" per square meter (decimeter) of treated surface came to $1.14\times10^{-3}$ kg (11.4 mg) and $1\times10^{-5}$ kg (0.1 mg), respectively.

Sample B was subjected to steps (1) and (2) only of the aforedescribed procedure, then dried with hot air.

Inner surfaces of samples A, B and C were analyzed using X-ray photoelectron spectroscopy (XPS) surface analysis technique giving the results for surface atomic composition reported in Table 2.

TABLE 2

| Surf. comp. [% atomic] | Sample A | Sample B | Sample C |
|---|---|---|---|
| Cu | 8.4 | 77.4 | 72.6 |
| Zn | 44.9 | 17.0 | 22.6 |
| Pb | 46.7 | 5.7 | 4.8 |

Figure 7:
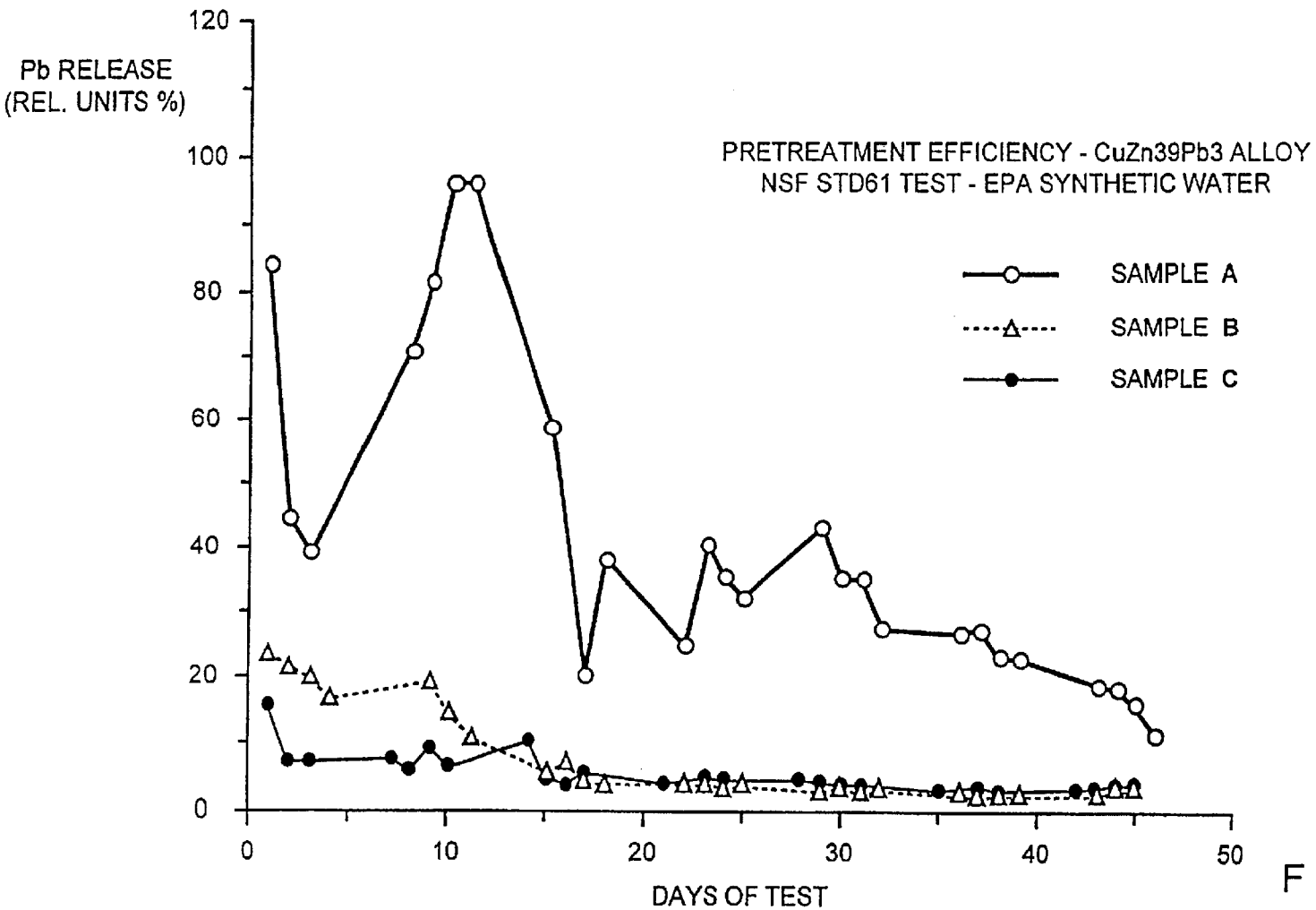
FIG. 7 is a graph showing the lead release mean values over time of Samples A, B, and C of Example 2, infra.

Samples A, B and C were then subjected to a test for the release of metallic ions in synthetic tap water, according to protocol NSF STD61, and using the synthetic water as described in the same protocol. Lead release mean values, recorded in the first 50 days of the test are shown in FIG. 7; according thereto, the amount of lead, released by sample C, treated according to the present invention, is less than 10% of the amount of lead released by sample A during the initial period of test. By comparing the plots for samples A, B and C, it is also evident the effect of step (3), which produces a passivation of the brass surface in contact with water, lowering lead release just from the beginning of the release test.

EXAMPLE 3 (COPPER ALLOYS)

Four samples A, B, C and D from the same bar in brass CuZn39Pb2 brass, normally extruded and drawn to 0.05 m (50 mm) diameter, normally available in commerce, were drilled and machined with lathe turning operation, under the same working conditions, obtaining 0.1 m (100 mm) high cylinders, with internal diameter of 0.036 m (36 mm) and 0.05 m (50 mm) external diameter. All samples were degreased and washed with tap water.

Samples A and B were subjected to lead-selective dissolution by:

1-immersion in solution "a": 0.1 M fluoboric acid at 40° C. for twenty minutes;

2-washing with water;

3-immersion in solution "b": 0.1 M NaOH at 20° C. for ten minutes;

4-washing with water and hot air-drying.

The overall amount of led and copper recovered from solutions "a" and "b" per square meter (square decimeter) of treated surface came to $7.3\times10^{-4}$ kg (7.3 mg) and $1\times10^{-5}$ kg (0.1 mg), respectively.

Sample B was subjected only to steps (1) and (2) of the aforedescribed procedure, then dried with hot air.

All samples were then subjected to a test for the release of metallic ions in synthetic tap water, according to protocol NSF STD61, and using the synthetic water as described in the said protocol for samples A and C, and tap water from the local water supply for samples B and D. Lead release values were recorded in the first 15 days of the release test showed that the amount of lead, released by sample A was equal to 10% of the amount released by sample C, and the amount of lead released by sample B was equal to 15% of the amount released by sample D.

EXAMPLE 4 (PLUMBING COMPONENTS)

Two samples A and B, of commercial brass ball valves, normally utilized as parts in water supply systems, were washed and degreased. Said samples shown an internal volume Iv, defined by the volume delimited only by metallic surfaces always in contact with water, of 0.027 l (27 ml). Only sample A was previously subjected to lead-selective dissolution by:

1-immersion in solution "a": 0.1 M sulfamic acid (pH 1.25) and 2% by weight 1H-benzotriazole as corrosion inhibitor, at 40° C. for twenty minutes;

2-washing with water;

3-immersion in solution "b": 0.1 M NaOH (pH 12.7) and 5% by weight of sodium metaphosphite as corrosion inhibitor, at 20° C. for ten minutes;

4-washing with water and hot air-drying.

The overall amount of lead and copper recovered from solutions "a" and "b" per l (ml) of said internal volume Iv came to $7.2\times10^{-5}$ kg/l (72 μg/ml) and $5\times10^{-6}$ kg/l (5 μg/ml), respectively.

Figure 8:
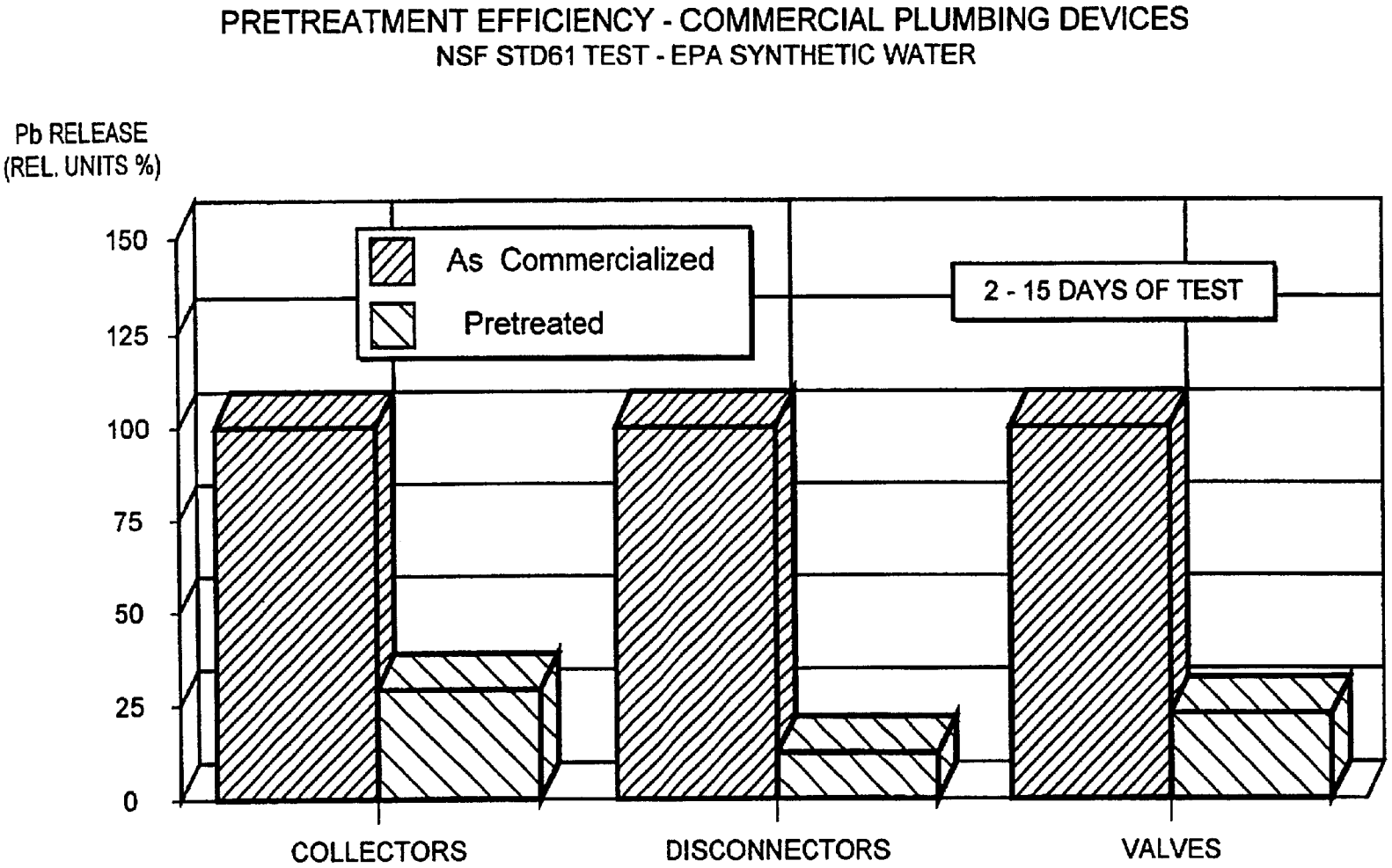
FIG. 8 is a graph showing the lead release values of plumbing components prepared according to Example 4, infra.

Samples A and B were then tested for metal release in synthetic drinking water following NSF STD61 protocol. Lead release mean values, recorded in the first 15 days of the release test, show that the amount of lead, released by sample A, is equal to 20% of the amount released by sample B. Further tests, carried out according to the procedure as described above, on other brass hydraulic commercial device parts, yielded comparable results, as reported in Table 3 and FIG. 8.

TABLE 3

Lead release according to NSF STD61 test averaged around the 15th day oftesting [μg/liter of Iv] ($\times10^{-9}$ kg/l)

| Device | As Comm. avail. | Pre-treated |
|---|---|---|
| Ball valve | 105 | 16 |
| Disconnector | 50 | 6 |
| Collector | 89 | 17 |

EXAMPLE 5 (PLUMBING COMPONENTS)

Two samples A and B, of commercial chromiun-plated brass faucets, normally available in commerce and utilized as distributors in water supply systems, were washed and degreased. Said samples shown an internal volume Iv, defined by the volume delimited only by metallic surfaces always in contact with water, of 0.08 l (80 ml). Only sample A was previously subjected to lead-selective dissolution according to the present invention, using:

1-immersion in solution "a": 0.1 M sulfamic acid, 0.1 M fluoboric acid and 0.5% by weight of 1-H-benzotriazole as corrosion inhibitor, at 40° C., for twenty minutes;

2-washing with water;

3-immersion in solution "b": 0.1 M NaOH, 0.1 M sodium metasilicate and 5% by weight of sodium metaphosphite as corrosion inhibitor, at 20° for ten minutes;

4-washing with water and hot air-drying.

The overall amount of lead and copper recovered from solutions "a" and "b" per ml of said internal volume Iv came to $5.5\times10^{-5}$ kg/l (55 μg/ml) and $1.1\times1^{-5}$ kg/l (11 μg/ml), respectively.

Faucets A and B were then inserted into a water supply system (municipal water supply system) and a daily sampling (0.1 l (100 ml)) was carried out from each tap, in the morning, after at least 16 hours stagnation. Lead concentration values in these samples were recorded in the first 15 days of operation. Such results show that the amount of mean released lead from samples taken from faucet A was equal to 26% of the mean amount registered in samples taken from faucet B.

After the completion of this fifteen days release test, samples of 0.1 l (100 ml) of water were drawn from A and B faucets after 8, 16 and 72 hours stagnation and after a flowing period of 10 minutes (these last values were taken as "zero time" points and subtracted as "blanks"). Lead concentration in all samples was determined by atomic absorption spectrometry and the results are shown in FIG. 9, and confirm that faucets A, pretreated according to the present invention, yields a significant better performance than commercial unpretreated faucet.

EXAMPLE 6 (COPPER ALLOYS)

Two samples, identified as A and B, were taken from the same bar in "Gun Metal 85-5-5-5" (a copper based alloy of nominal composition, by weight: 5% lead, 5% zinc, 5% tin and 85% copper) extruded and drawn to 0.05 m (50 mm) diameter, normally available in commerce. Both samples were drilled and machined with lathe turning operation, under the same working conditions, in order to obtain 0.1 m (100 mm) high cylinders with internal diameter of 0.036 m (36 mm) and external diameter of 0.05 m (50 mm). Both samples were degreased and washed with tap water.

Sample A, according to the present invention, was subjected to lead selective dissolution by:

1-immersion in solution "a": 0.1 M sulfamic acid and 0.1 M fluoboric acid at 40° C. for 25 minutes;

2-washing with water;

3-immersion in solution "b": 0.1 M NaOH, 0,1 M sodium metasilicate and 5% by weight of sodium metaphosphite, at 20° C. for 10 minutes;

4-washing with water and hot air drying.

The overall amount of lead and copper recovered from solutions "a" and "b" per square meter (decimeter) of treated surface came to $28.5\times10^{-3}$ kg (285 mg) and $1.8\times10^{-4}$ kg (1.8 mg), respectively.

Inner surfaces of A and B samples were analyzed using X rays photoelectron spectroscopy (XPS) surface analysis technique giving the results for surface atomic composition reported in Table 4.

TABLE 4

| Surf. comp. [atomic %] | Sample A | Sample B |
|---|---|---|
| Cu | 83.9 | 53.0 |
| Zn/Sn | 2.8 | 4.0 |
| Pb | 13.3 | 43.1 |

EXAMPLE 7 (PLUMBING COMPONENTS)

Two samples, A and B, of commercial chromium plated brass faucets, normally available in commerce and utilized as distributors in water supply systems, were washed and degreased. Said samples shown an internal volume Iv, defined as the volume delimited only by metallic surfaces always in contact with water, of 0.2 l (200 ml). Only sample A was previously subjected to lead selective dissolution according to the present invention, using:

1-immersion in solution "a": 0.1 M sulfamic acid, at 40° C. for 25 minutes;

2-washing with water;

3-immersion in solution "b": 0.1 M NaOH, 5% by weight of sodium metaphosphite (corrosion inhibitor) and 0.5% by weight of polyetoxyalchool (as a surface wetting agent), at 20° C. for 10 minutes;

4-washing with water and hot air drying.

The overall amount of lead and copper recovered from solutions "a" and "b" per ml of said internal volume Iv came to $4.4\times10^{-3}$ kg/l (440 μg/ml) and $3.3\times10^{-4}$ kg/l (33 μg/ml), respectively.

Figure 10:
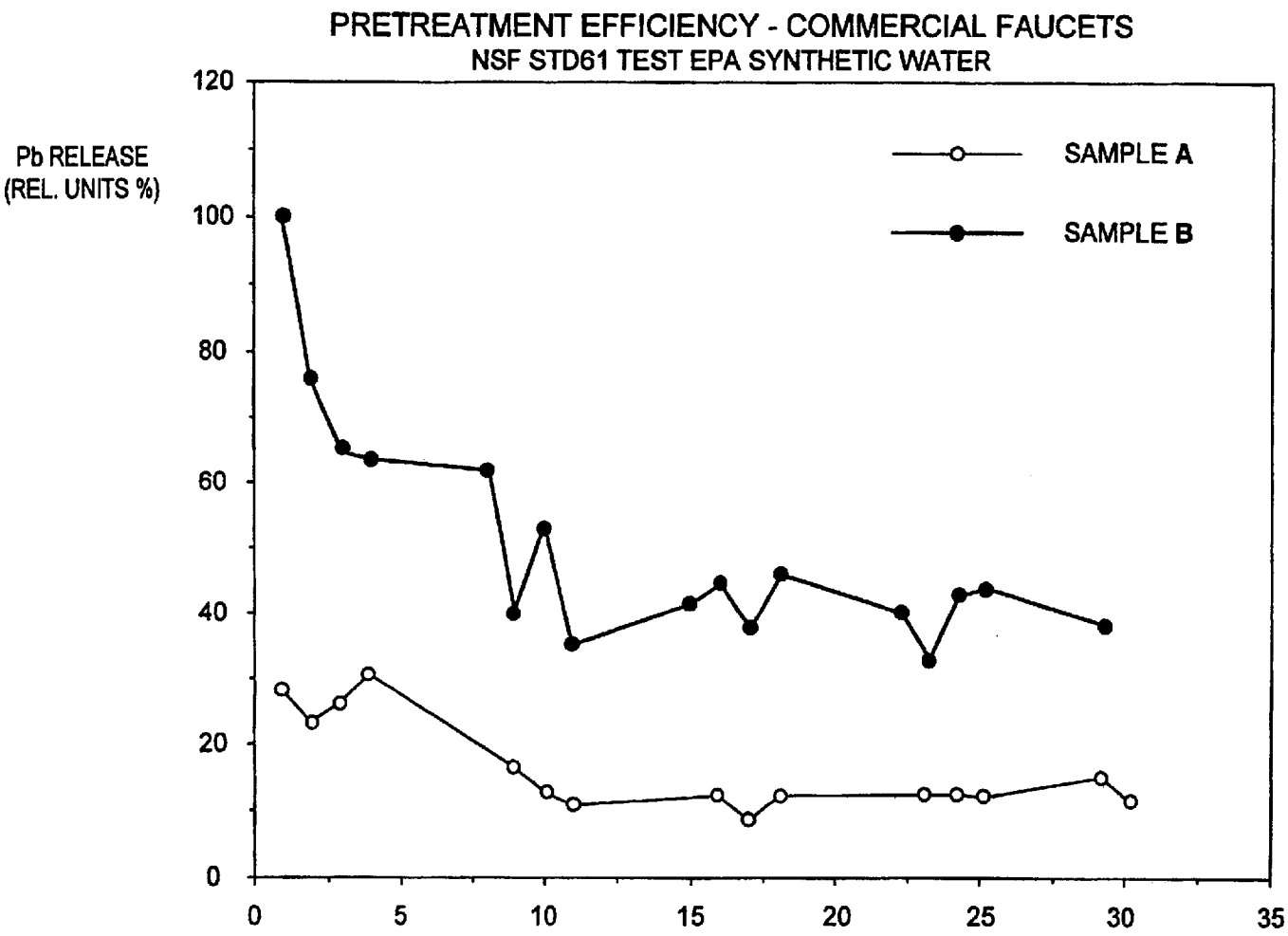
FIG. 10 is a graph showing the lead release values of faucets prepared according to Example 7, infra.

Faucets A and B were then tested for metal release in syntethic drinking water following NSF STD61 protocol for four weeks. Lead release mean values recorded during the first 15 days of test show that lead release for pretreated faucet A is 35% of lead release observed for faucet B. At around the 15th day of the test, the lead release from faucet A is about $2.1\times10^{-8}$ kg/l (21 $\mu$g/l) of Iv volume, while for faucet B the figure is around $8\times10^{-8}$ kg/l (80 $\mu$g,l) of Iv volume. FIG. 10 shows results obtained during the four weeks lead release test for faucets A and B.

What is claimed is:

1. A treating aqueous solution for performing a selective Pb etching mechanical components made of copper-based metal alloys containing Pb, the selective etching being directed against a surface enrichment in Pb and Pb salts of respective surfaces of said components which have been subjected to working operations carried out either by machining, molding or die-casting, said treating solution being characterized in having the following composition:

0.1 M sulfamic acid;

0.1 M fluoboric acid;

from 0.1 to 5% by weight of 1H-benzotriazole.

* * * * *